US010896655B2

(12) United States Patent
Kim et al.

(10) Patent No.: US 10,896,655 B2
(45) Date of Patent: Jan. 19, 2021

(54) DISPLAY DEVICE

(71) Applicant: Samsung Display Co., Ltd., Yongin-Si (KR)

(72) Inventors: Dongin Kim, Suwon-si (KR); Jinkyu Park, Seoul (KR); Joon-chul Goh, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 96 days.

(21) Appl. No.: 16/241,774

(22) Filed: Jan. 7, 2019

(65) Prior Publication Data

US 2019/0213971 A1 Jul. 11, 2019

(30) Foreign Application Priority Data

Jan. 8, 2018 (KR) ..... 10-2018-0002399

(51) Int. Cl.
*G09G 3/36* (2006.01)

(52) U.S. Cl.
CPC ..... *G09G 3/3696* (2013.01); *G09G 3/3611* (2013.01); *G09G 3/3685* (2013.01); *G09G 2300/0426* (2013.01); *G09G 2300/0819* (2013.01); *G09G 2310/0286* (2013.01); *G09G 2310/08* (2013.01); *G09G 2320/0276* (2013.01); *G09G 2340/0435* (2013.01)

(58) Field of Classification Search
CPC .. G09G 3/3696; G09G 3/3611; G09G 3/3685; G09G 2300/0426; G09G 2300/0819; G09G 2310/0286; G09G 2310/08; G09G 2320/0276; G09G 2340/0435
See application file for complete search history.

(56) References Cited

U.S. PATENT DOCUMENTS 9,182,805 B2 11/2015 Kim et al.
9,916,799 B1 * 3/2018 Jo ..... G09G 3/3618
2002/0101180 A1 * 8/2002 Shino ..... G09G 3/22 315/169.3
2002/0145578 A1 * 10/2002 Ito ..... G09G 3/3692 345/87
2004/0217932 A1 * 11/2004 Nally ..... G09G 3/3648 345/92

(Continued)

FOREIGN PATENT DOCUMENTS

KR 10-1560238 B1 10/2015
KR 10-2016-0149454 A 12/2016

(Continued)

*Primary Examiner* — Sejoon Ahn
(74) *Attorney, Agent, or Firm* — Lewis Roca Rothgerber Christie LLP

(57) ABSTRACT

A display device includes a memory, a signal controller, and a voltage generator. A plurality of data is stored in the memory. The signal controller detects a frame rate of an externally applied image data signal, selects data corresponding to the detected frame rate among the plurality of data, and outputs a control signal corresponding to the selected data. The voltage generator includes a DC-DC converter for determining an output voltage in correspondence to the control signal and a feedback circuit for determining a current flowing inside and a frequency of an outputted signal in correspondence to the control signal.

17 Claims, 9 Drawing Sheets

(56) References Cited

U.S. PATENT DOCUMENTS

2006/0232501 A1* 10/2006 Weiss ..... H05B 45/20 345/46
2007/0262948 A1* 11/2007 Han ..... G09G 3/3406 345/102
2008/0186263 A1* 8/2008 Lee ..... G09G 3/3225 345/82
2010/0039364 A1* 2/2010 Lee ..... G09G 3/3696 345/100
2010/0039367 A1* 2/2010 Tai ..... G09G 3/3413 345/102
2011/0090204 A1* 4/2011 Yamazaki ..... G09G 3/3677 345/211
2011/0102481 A1* 5/2011 Miyasaka ..... G09G 3/344 345/690
2013/0265807 A1* 10/2013 Lee ..... H02M 3/156 363/49
2016/0180756 A1* 6/2016 Go ..... G09G 3/3648 345/33
2017/0124958 A1 5/2017 Pyo et al.
2017/0337883 A1* 11/2017 Zhou ..... G09G 3/3413
2017/0337890 A1 11/2017 Lee et al.
2018/0096648 A1* 4/2018 Kurokawa ..... G06F 1/3265
2020/0084341 A1* 3/2020 Hundemer ..... H04N 21/4307

FOREIGN PATENT DOCUMENTS

KR 10-2017-0045953 A 4/2017
KR 10-2017-0049735 A 5/2017
KR 10-2017-0130676 A 11/2017
KR 10-1793284 B1 11/2017

* cited by examiner

DISPLAY DEVICE

CROSS-REFERENCE TO RELATED APPLICATION

This application claims priority to and the benefit of Korean Patent Application No. 10-2018-0002399, filed on Jan. 8, 2018 in the Korean Intellectual Property Office, the entire content of which is hereby incorporated by reference.

BACKGROUND

1. Field

Aspects of embodiments of the present disclosure relate to a display device for displaying an image in which a frame rate is changed.

2. Description of Related Art

A display device receives an image data signal from an external device, such as a graphic card, and displays an image corresponding to the received image data signal.

The frame rate of an image data signal received by the display device may not be constant, but may vary. In order to display an image corresponding to the variable frame rate, the display device may further include additional hardware.

When the frame rate is changed, the voltage applied to the elements inside the display device may fluctuate irregularly, or crosstalk may occur such that the quality of the image displayed on the display device may be deteriorated.

SUMMARY

According to an aspect of embodiments of the present disclosure, a display device is capable of providing a high-quality image even when the frame rate of an image data signal changes.

According to one or more embodiments of the inventive concept, a display device includes: a memory configured to store a plurality of data; a signal controller including a receiver to receive image data from the outside, a first register to read the plurality of data stored in the memory, and a power controller, wherein the power controller includes a frequency detector to detect a frequency of the received image data and an operation controller to output a control signal based on data corresponding to the detected frequency among the plurality of data read by the first register; and a voltage generator including a plurality of output circuits to output a plurality of voltages in correspondence to the control signal. At least one of the plurality of output circuits includes: a DC-DC converter; and a feedback circuit configured to control an output of the DC-DC converter and including a first comparator, a second comparator, and a PWM controller. At least one of an output voltage of the DC-DC converter, a current between the first comparator and the second comparator, and a frequency of a signal outputted from the PWM controller is changed in correspondence to the control signal.

In an embodiment, as the detected frequency is higher, the output voltage of the DC-DC converter may become greater.

In an embodiment, as the detected frequency is higher, the current between the first comparator and the second comparator may become greater.

In an embodiment, as the detected frequency is higher, the frequency of the signal outputted from the PWM controller may become higher.

In an embodiment, the feedback circuit may further include a current controller having one end connected to a node between the first comparator and the second comparator and another end connected to a ground voltage, and the current controller includes a variable resistor and a capacitor.

In an embodiment, a resistance value of the variable resistor may be changed in correspondence to the detected frequency.

In an embodiment, when the resistance value of the variable resistor is smaller, a magnitude of the current outputted from the current controller may become greater.

In an embodiment, the signals outputted by the PWM controller may include a plurality of pulse waves, and a part of the plurality of pulse waves may be skipped in correspondence to the detected frequency.

In an embodiment, as the detected frequency is smaller, a number of pulse waves skipped for a certain time in the plurality of pulse waves may increase.

In an embodiment, when the detected frequency changes, a pulse width of each of the plurality of pulse waves may be constant.

In an embodiment, the display device may further include a display panel, a gate driver, a data driver, and a gamma voltage generator. The plurality of output circuits may include: a first output circuit configured to boost an inputted reference voltage to provide a gamma voltage source to the gamma voltage generator; a second output circuit configured to boost the gamma voltage source to provide a gate-on voltage to the gate driver; a third output circuit configured to reduce an inputted reference voltage to provide a core voltage to the signal controller; a fourth output circuit configured to reduce an inputted reference voltage to provide a driving voltage to the data driver; and a fifth output circuit configured to reduce an inputted reference voltage to provide a gate-off voltage to the gate driver.

In an embodiment, the first output circuit and the second output circuit may be respectively a boost converter, the third output circuit and the fourth output circuit may be respectively a buck converter, and the fifth output circuit may be a negative charge pump.

In an embodiment, a voltage of the gamma voltage source may be 16 V or more and 18 V or less, the gate-on voltage may be 28 V or more and 38 V or less, the core voltage may be 1 V or more and 2 V or less, the driving voltage may be 1 V or more and 2 V or less, and the gate-off voltage may be −7 V or more and −5 V or less.

According to one or more embodiments of the inventive concept, a display device includes: a memory configured to store a plurality of data; a signal controller configured to detect a frame rate of an externally applied image data signal, select data corresponding to the detected frame rate among the plurality of data, and output a control signal corresponding to the selected data; and a voltage generator including a DC-DC converter to determine an output voltage in correspondence to the control signal, and a feedback circuit to determine a current flowing inside and a frequency of an outputted signal in correspondence to the control signal.

BRIEF DESCRIPTION OF THE FIGURES

The accompanying drawings are included to provide a further understanding of the inventive concept, and are incorporated in and constitute a part of this specification. The drawings illustrate some exemplary embodiments of the inventive concept and, together with the description, serve to explain principles of the inventive concept. In the drawings.

DETAILED DESCRIPTION

Figure 1:
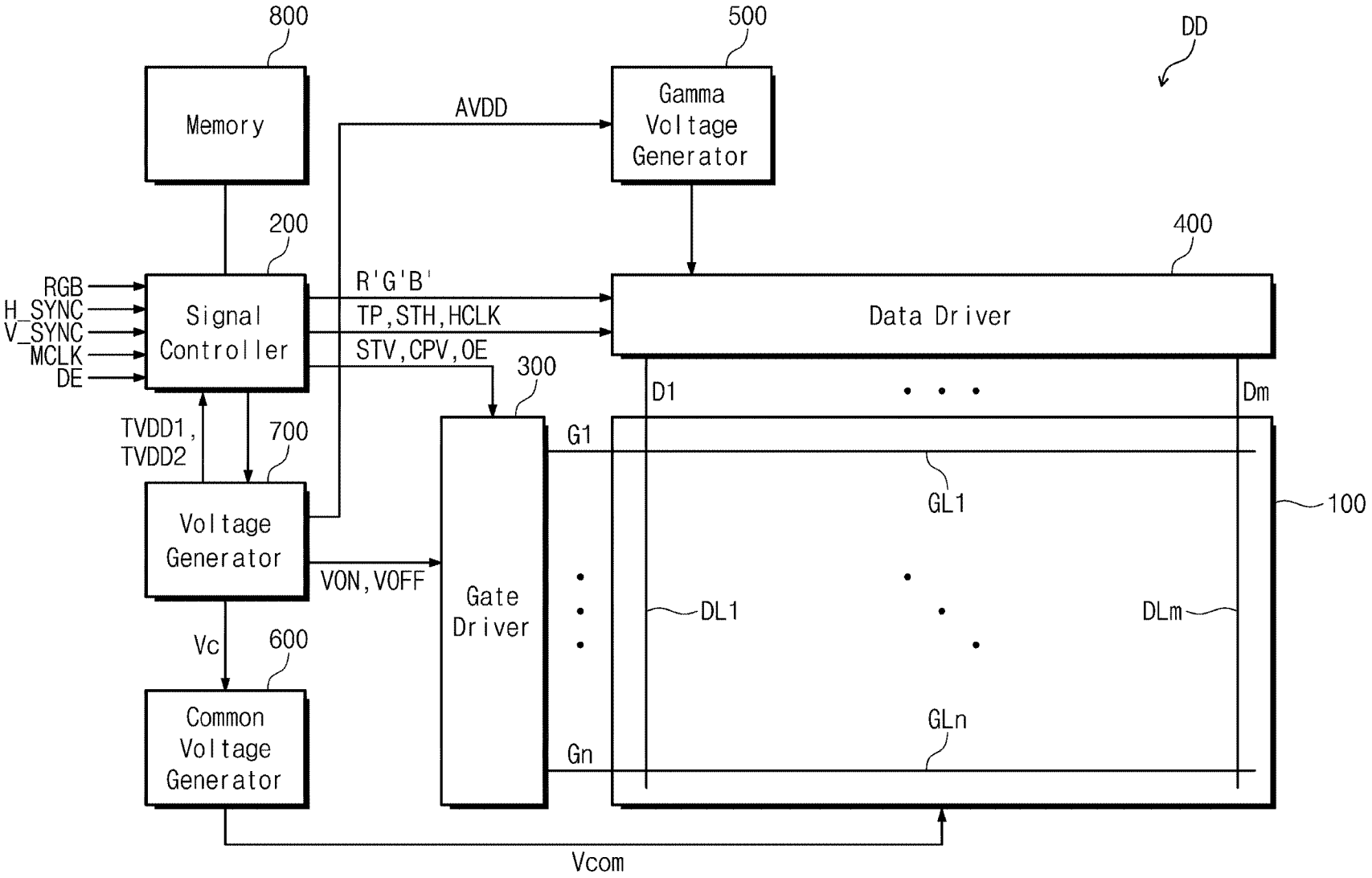
FIG. 1 is a block diagram of a display device according to an embodiment of the inventive concept.

Herein, some embodiments of the inventive concept will be described with reference to the drawings.

In the drawings, thicknesses, proportions, and dimensions of components may be exaggerated for purposes of description.

In various embodiments of the inventive concept, the terms "include," "comprise," "including," or "comprising," may specify a property, a region, a fixed number, a step, a process, an element, and/or a component, but do not exclude other properties, regions, fixed numbers, steps, processes, elements, and/or components.

Figure 2:
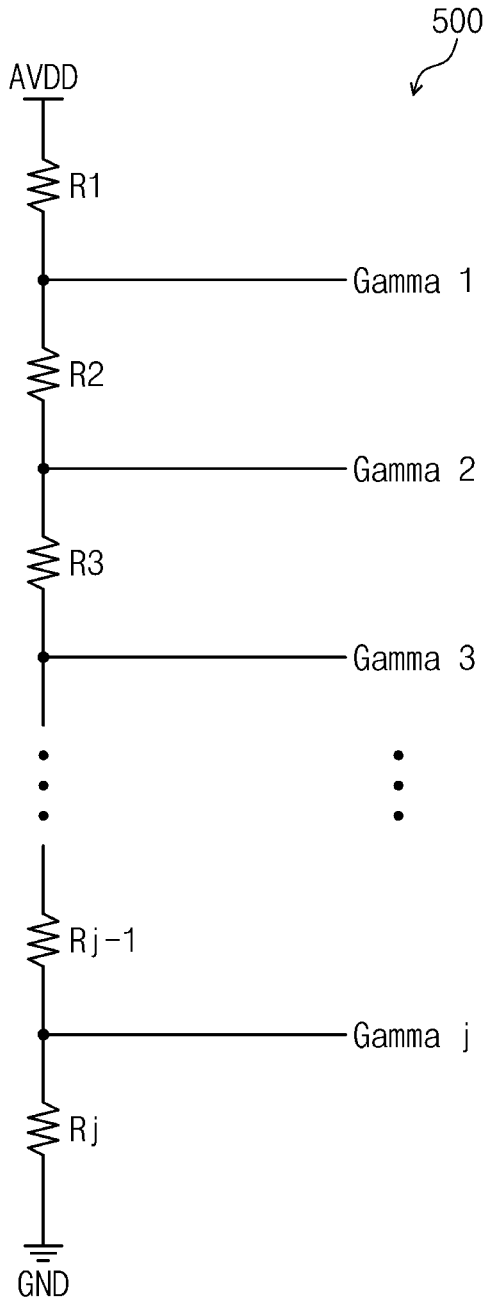
FIG. 2 illustrates an exemplary circuit diagram of a gamma voltage generator shown in FIG. 1.
Figure 3:
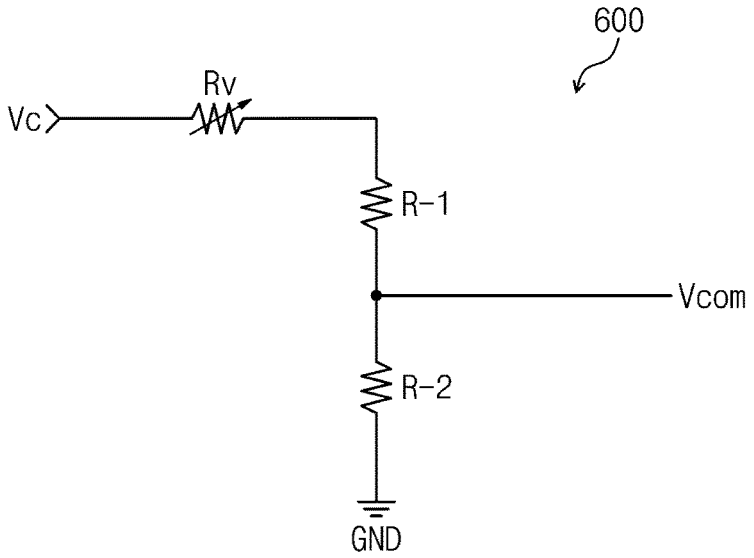
FIG. 3 illustrates an exemplary circuit diagram of a common voltage generator shown in FIG. 1.

FIG. 1 is a block diagram of a display device DD according to an embodiment of the inventive concept; FIG. 2 illustrates an exemplary circuit diagram of a gamma voltage generator 500 shown in FIG. 1; and FIG. 3 illustrates an exemplary circuit diagram of a common voltage generator 600 shown in FIG. 1.

Referring to FIG. 1, a display device DD according to an embodiment of the inventive concept includes a display panel 100, a signal controller (or a timing controller) 200, a gate driver 300, a data driver 400, a gamma voltage generator 500, a common voltage generator 600, a voltage generator 700, and a memory 800.

The display panel 100 includes a plurality of gate lines GL1 to GLn, a plurality of data lines DL1 to DLm intersecting the gate lines GL1 to GLn, and a plurality of pixels PX. The plurality of gate lines GL1 to GLn are connected to the gate driver 300. The plurality of data lines DL1 to DLm are connected to the data driver 400. Only some of the plurality of gate lines GL1 to GLn and only some of the plurality of data lines DL1 to DLm are illustrated in FIG. 1. In addition, the display panel 100 may further include a dummy gate line (not shown).

The pixels PX are respectively connected to corresponding gate lines among the plurality of gate lines GL1 to GLn and corresponding data lines among the plurality of data lines DL1 to DLm.

The plurality of pixels PX may be divided into a plurality of groups according to a color displayed. The plurality of pixels PX may display one of primary colors. The primary colors may include red, green, blue, and white. However, the inventive concept is not limited thereto, and the primary color may further include any of various colors, such as yellow, cyan, and magenta.

In an embodiment, the signal controller 200 receives an image data signal RGB, a horizontal synchronization signal H_SYNC, a vertical synchronization signal V_SYNC, a clock signal MCLK, and a data enable signal DE from an external device. The signal controller 200 converts the data format of the image data signal RGB according to the interface specification with the data driver 400 and outputs a converted image data signal R'G'B' to the data driver 400. In an embodiment, the signal controller 200 outputs a data control signal (e.g., an output start signal TP, a horizontal start signal STH, and a clock signal HCLK) to the data driver 400, and outputs a gate control signal (e.g., a vertical start signal STV, a gate clock signal CPV, and an output enable signal OE) to the gate driver 300.

Also, the signal controller 200 may receive the core voltages TVDD1 and TVDD2 from the voltage generator 700. The signal controller 200 may receive any one of the core voltages TVDD1 and TVDD2 generated by the voltage generator 700 and may use it as a power for driving it.

The gate driver 300 may receive a gate-on voltage VON and a gate-off voltage VOFF from the voltage generator 700 and may sequentially output the gate signals G1 to Gn in response to the gate control signals STV, CPV, and OE provided from the signal controller 200. The gate signals G1 to Gn are sequentially supplied to the gate lines GL1 to GLn of the display panel 100 to sequentially scan the gate lines GL1 to GLn. Although not shown in the drawings, the display device DD may further include a regulator for converting an input voltage into a gate-on voltage and a gate-off voltage and outputting them.

The data driver 400 generates a plurality of data voltages (or gradation voltages) using the gamma voltages provided from the gamma voltage generator 500. Upon receiving the data control signals TP, STH, and HCLK from the signal controller 200, the data driver 400 selects the data voltages corresponding to the converted image data signal R'G'B' among the generated data voltages and provides the selected data voltages as the data signals D1 to Dm to the data lines DL1 to DLm of the display panel 100.

When the gate signals G1 to Gn are sequentially supplied to the gate lines GL1 to GLn, the data signals D1 to Dm are provided to the data lines DL1 to DLm in synchronization therewith.

Referring to FIG. 2, the gamma voltage generator 500 generates gamma voltages Gamma 1 to Gamma j having different voltage levels using a gamma voltage source AVDD provided from the voltage generator 700, and provides the gamma voltages Gamma 1 to Gamma j to the data driver 400. The gamma voltage generator 500 may include a plurality of gamma voltage dividing resistances R1 to Rj for dividing the gamma voltage source AVDD.

The gamma voltage Gamma 1 outputted from the output terminal between the first gamma voltage dividing resistance R1 and the second gamma voltage dividing resistance R2 has the highest voltage value, and the gamma voltage Gamma j outputted from the output terminal between the (j−1)-th gamma voltage dividing resistance Rj−1 and the j-th gamma voltage dividing resistance Rj may have the lowest voltage value.

In an embodiment of the inventive concept, the gamma voltage generator 500 may be integrated with the data driver 400, or the gamma voltage generator 500 may be included in the data driver 400.

Referring to FIG. 3, the common voltage generator 600 generates a common voltage Vcom using the common voltage source Vc provided from the voltage generator 700, and outputs the generated common voltage Vcom to the display panel 100. Referring to FIG. 3, the common voltage generator 600 includes resistors R-1 and R-2 and a variable resistor Rv for dividing the voltage of the common voltage source Vc supplied from the voltage generator 700. The common voltage Vcom may be outputted at the output terminal between the resistors R-1 and R-2. The common voltage Vcom may be adjusted by adjusting the resistance value of the variable resistor Rv.

In an embodiment of the inventive concept, the common voltage generator 600 may be integrated with the voltage generator 700, or the common voltage generator 600 may be included in the voltage generator 700.

The memory 800 may store information on voltage values of signals exchanged between the respective components 100, 200, 300, 400, 500, 600, and 700 in the display device DD. The memory 800 may be a separate component or may be included in at least one of the components 100, 200, 300, 400, 500, 600, and 700.

In correspondence to a change in frequency (or frame rate) of the image data signal RGB, the memory 800 may store data on the levels of the core voltages TVDD1 and TVDD2 that the voltage generator 700 provides to the signal controller 200 or the data driver 400, the levels of the gate-on voltage VON and the gate-off voltage VOFF provided to the gate driver 300, and the level of the gamma voltage source AVDD provided to the gamma voltage generator 500.

In an embodiment, for example, the voltage of the gamma voltage source AVDD is 16 V or more and 18 V or less, the gate-on voltage VON is 28 V or more and 38 V or less, the core voltages TVDD1 and TVDD2 are 1 V or more and 2 V or less, and the gate-off voltage is −7 V or more and −5 V or less. However, the inventive concept is not limited thereto.

Figure 4:
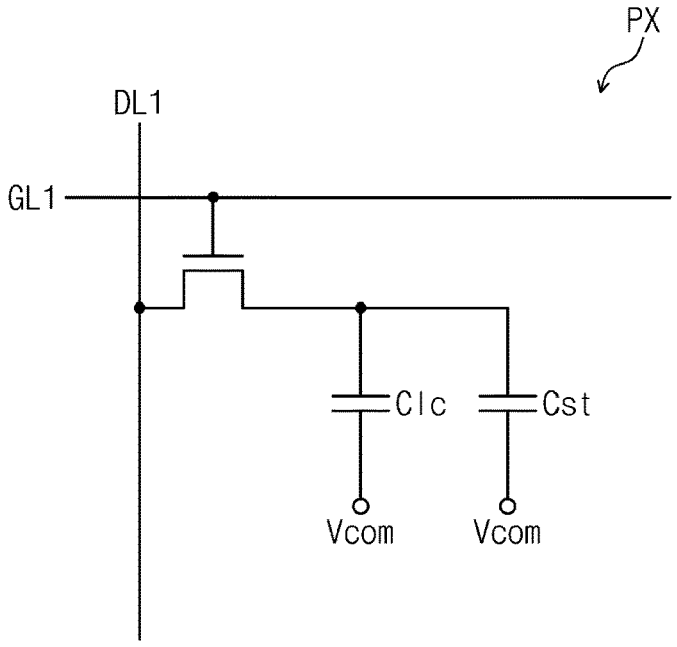
FIG. 4 is an equivalent circuit diagram of a pixel according to an embodiment of the inventive concept.
Figure 5:
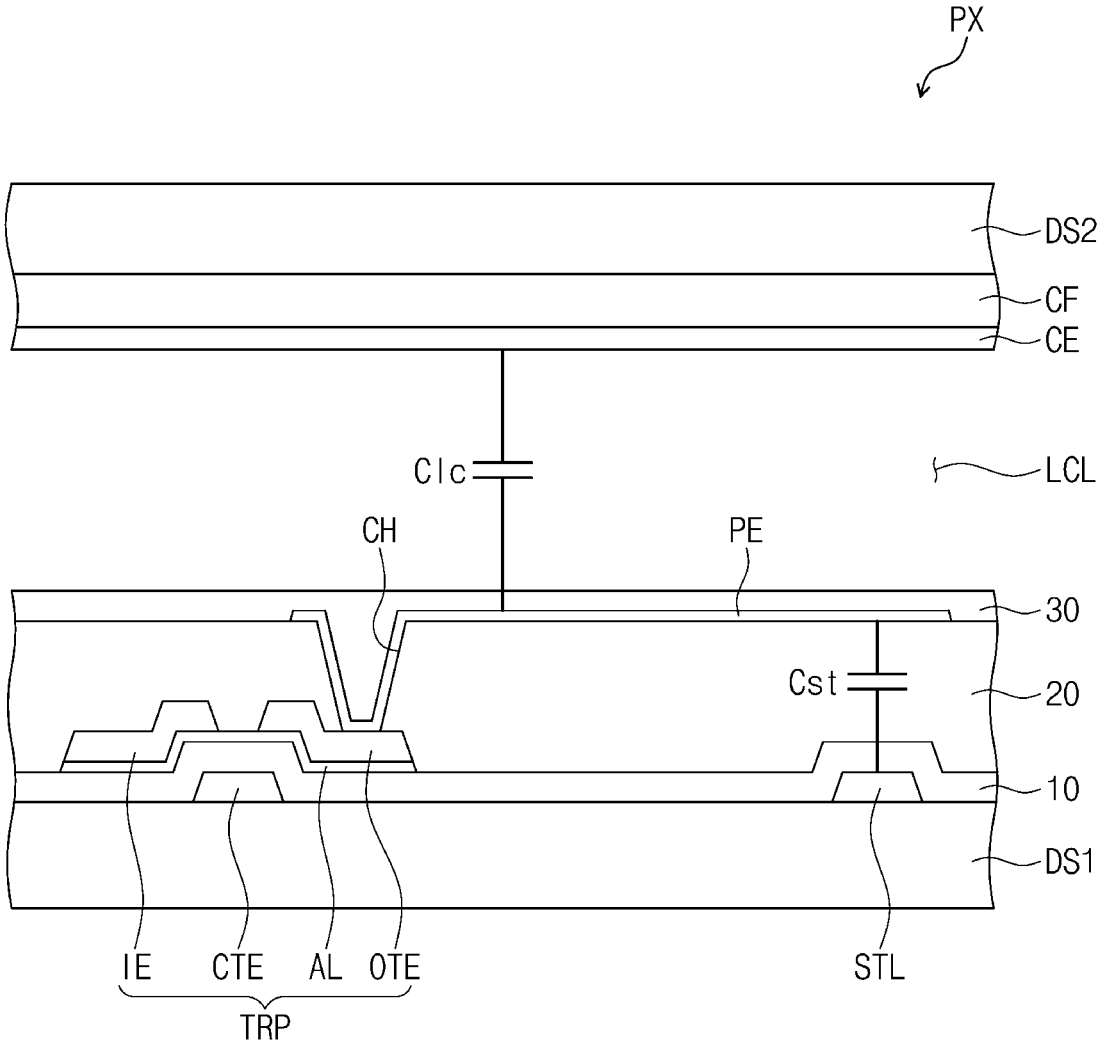
FIG. 5 is a cross-sectional view of a pixel according to an embodiment of the inventive concept.

FIG. 4 is an equivalent circuit diagram of a pixel PX according to an embodiment of the inventive concept; and FIG. 5 is a cross-sectional view of a pixel PX according to an embodiment of the inventive concept.

In an embodiment, as shown in FIG. 4, the pixel PX includes a pixel thin film transistor (herein referred to as a pixel transistor) TRP, a liquid crystal capacitor Clc, and a storage capacitor Cst.

Herein, in this specification, a transistor refers to a thin film transistor. In an embodiment of the inventive concept, the storage capacitor Cst may be omitted.

In FIGS. 4 and 5, a pixel transistor TRP electrically connected to the first gate line GL1 and the first data line DL1 is illustrated as an example.

The pixel transistor TRP outputs a pixel voltage corresponding to the data signal received from the first data line DL1 in response to the gate signal received from the first gate line GL1.

The liquid crystal capacitor Clc charges a pixel voltage outputted from the pixel transistor TRP. An arrangement of liquid crystal directors included in a liquid crystal layer LCL (see FIG. 5) is changed according to a charge amount charged in the liquid crystal capacitor Clc. The light incident to a liquid crystal layer may be transmitted or blocked according to an arrangement of liquid crystal directors.

The storage capacitor Cst is connected in parallel to the liquid crystal capacitor Clc. The storage capacitor Cst maintains an arrangement of liquid crystal directors during a predetermined section.

In an embodiment, as shown in FIG. 5, the pixel transistor TRP includes a control electrode CTE connected to the first gate line GL1 (see FIG. 4), an activation layer AL overlapping the control electrode CTE, an input electrode IE connected to the line DL1 (see FIG. 4), and an output electrode OTE spaced apart from the input electrode IE.

The liquid crystal capacitor Clc includes a pixel electrode PE and a common electrode CE. The storage capacitor Cst includes the pixel electrode PE and a portion of a storage line STL overlapping the pixel electrode PE. The common voltage Vcom (see FIG. 3) is applied to the common electrode CE, and the data signals D1 to Dm are applied to the pixel electrode PE.

The first gate line GL1 and the storage line STL are disposed on one surface of a first substrate DS1. The control electrode CTE is branched from the first gate line GL1. The first gate line GL1 and the storage line STL may include a metal (such as Al, Ag, Cu, Mo, Cr, Ta, Ti, and so on) or an alloy thereof. In an embodiment, the first gate line GL1 and the storage line STL may have a multi-layer structure and, for example, may include a Ti layer and a Cu layer.

A first insulating layer 10 covering the control electrode CTE and the storage line STL is disposed on one surface of the first substrate DS1. The first insulating layer 10 may include at least one of an inorganic material and an organic material. The first insulating layer 10 may be an organic film or an inorganic film. In an embodiment, the first insulating layer 10 may have a multi-layer structure and, for example, may include a silicon nitride layer and a silicon oxide layer.

The activation layer AL overlapping the control electrode CTE is disposed on the first insulating layer 10. In an embodiment, the activation layer AL may include a semiconductor layer (not shown) and an ohmic contact layer (not shown).

In an embodiment, the activation layer AL may include amorphous silicon or poly silicon. Additionally, the activation layer AL may include a metal oxide semiconductor.

The output electrode OTE and the input electrode IE are disposed on the activation layer AL. The output electrode OTE and the input electrode IE are disposed spaced apart from each other. Each of the output electrode OTE and the input electrode IE may partially overlap the control electrode CTE.

Although the pixel transistor TRP having a staggered structure is shown in FIG. 5 exemplarily, a structure of the pixel transistor TRP is not limited thereto. In an embodiment, the pixel transistor TRP may have a planar structure.

A second insulating layer 20 covering the activation layer AL, the output electrode OTE, and the input electrode IE is disposed on the first insulating layer 10. The second insulating layer 20 provides a flat surface. The second insulating layer 20 may include an organic material.

A pixel electrode PE is disposed on the second insulating layer 20. The pixel electrode PE is connected to the output electrode OTE through a contact hole CH that penetrates the second insulating layer 20. An alignment film 30 covering the pixel electrode PE may be disposed on the second insulating layer 20.

A color filter layer CF is disposed on a surface of a second substrate DS2. A common electrode CE is disposed on a surface of the color filter layer CF. A common voltage is applied to the common electrode CE. A common voltage and a pixel voltage have different values. An alignment layer (not shown) covering the common electrode CE may be disposed on the common electrode CE. In an embodiment, another insulating layer may be disposed between the color filter layer CF and the common electrode CE.

The pixel electrode PE and the common electrode CE with a liquid crystal layer LCL therebetween form the liquid crystal capacitor Clc. Additionally, portions of the pixel electrode PE and the storage line STL, which are disposed with the first insulating layer 10 and the second insulating layer 20 therebetween, form the storage capacitor Cst. The storage line STL receives a storage voltage having a different value than a pixel voltage. A storage voltage may have the same value as a common voltage.

However, the cross-section of the pixel PX shown in FIG. 5 is only one example, and the present invention is not limited thereto. In an embodiment, unlike FIG. 5, at least one of the color filter layer CF and the common electrode CE may be disposed on the first substrate DS1. That is, a display panel according to another embodiment of the inventive concept may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 6:
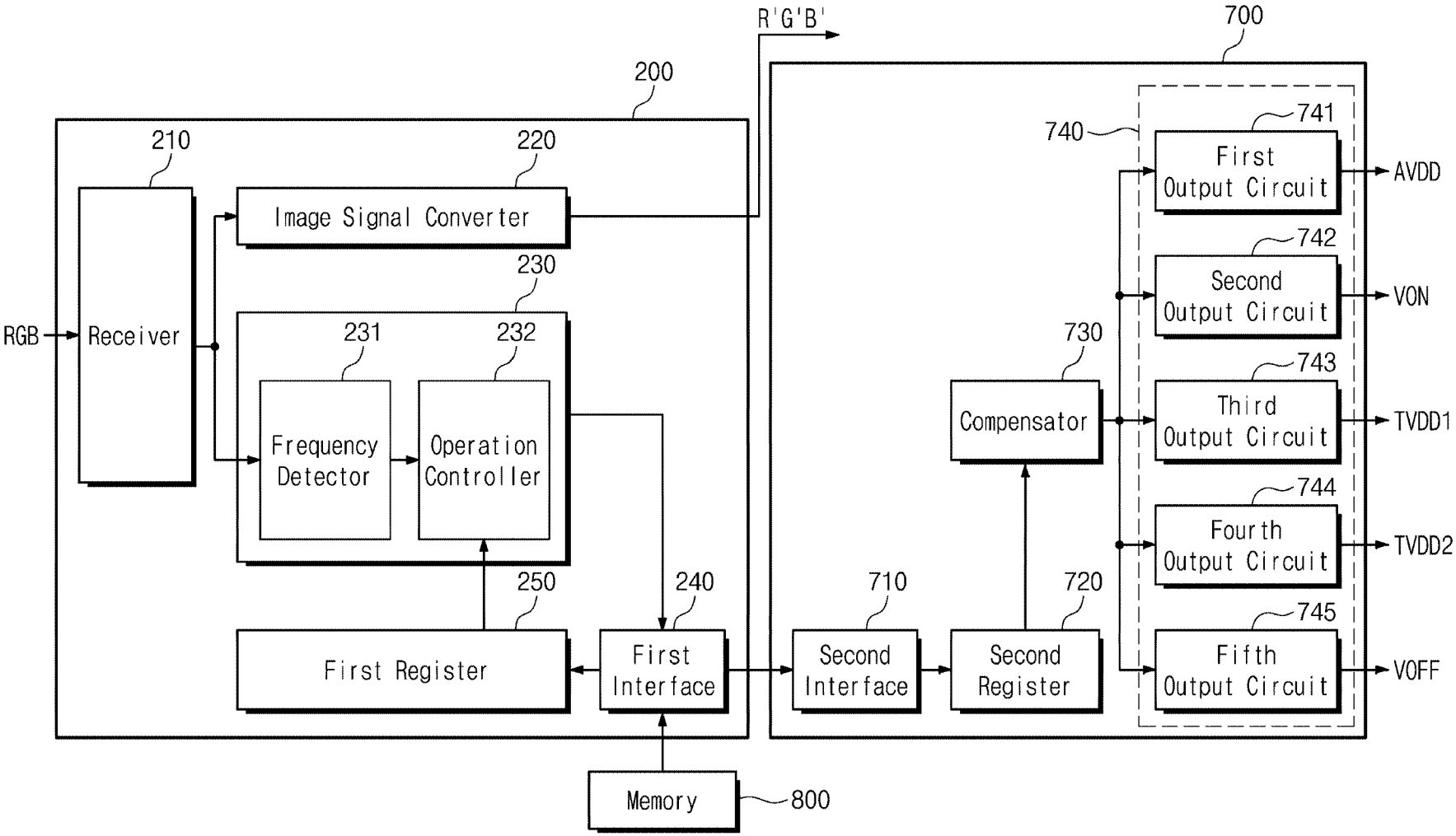
FIG. 6 is a block diagram illustrating a relationship between a signal controller, a voltage generator, and a memory shown in FIG. 1.
Figure 7:
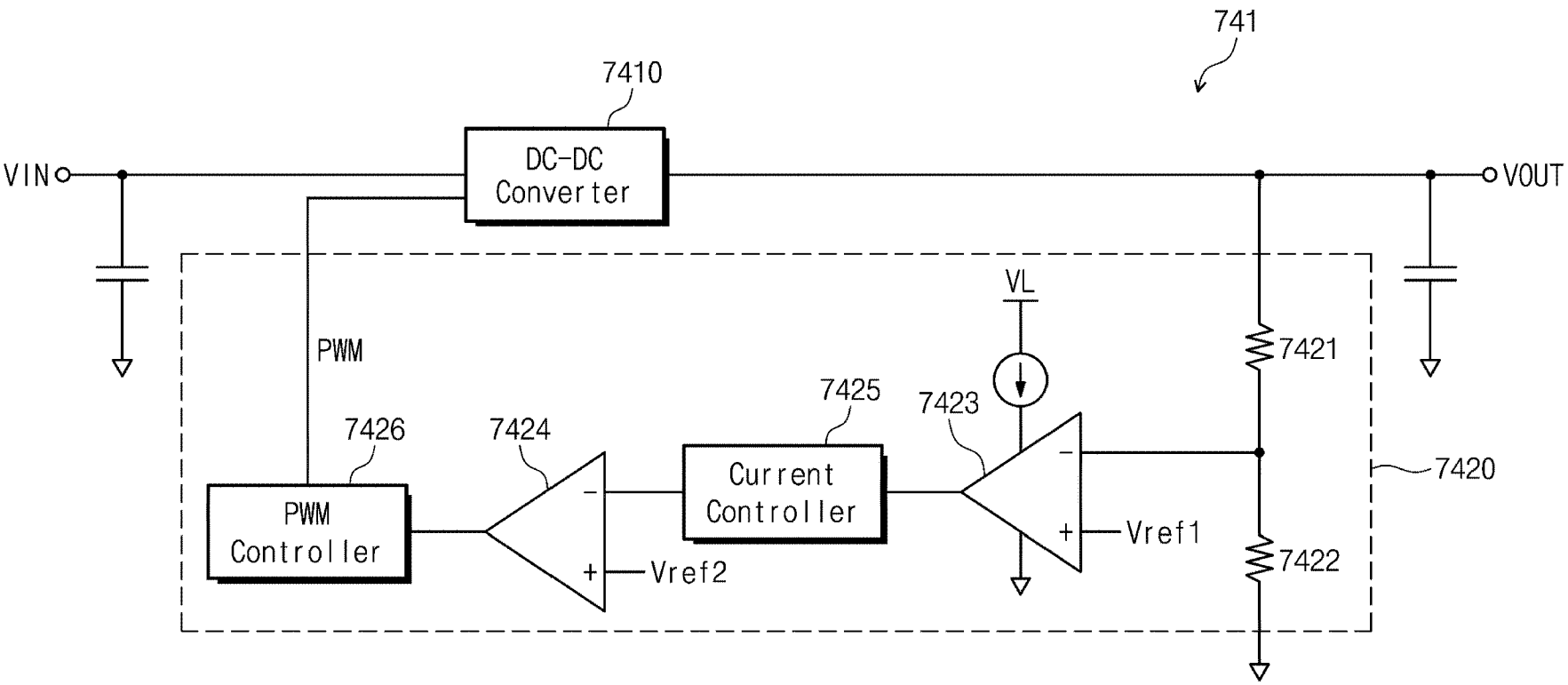
FIG. 7 illustrates an equivalent circuit diagram of an output circuit of a voltage generator.
Figure 8:
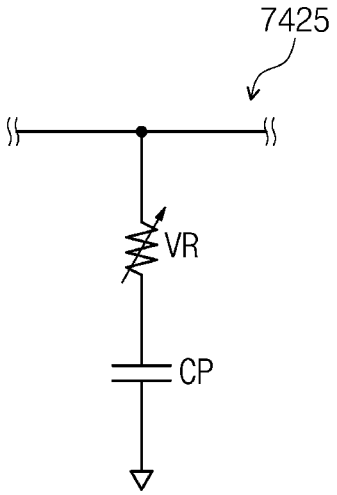
FIG. 8 exemplarily shows an equivalent circuit of a current controller of FIG. 7.
Figure 9A:
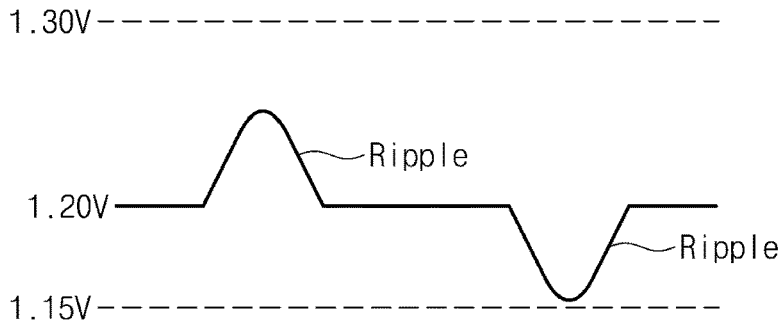
FIGS. 9A, 9B, and 9C illustrate a change in a first core voltage according to a frame rate of an image data signal.
Figure 9B:
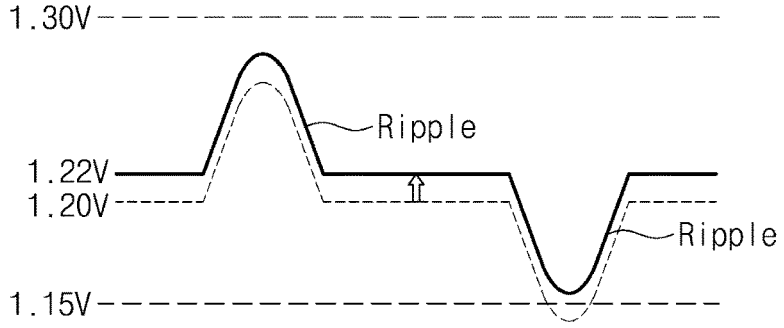
Figure 9C:
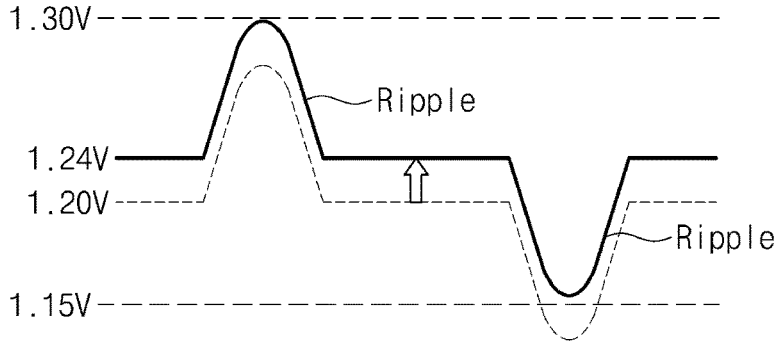

FIG. 6 is a block diagram illustrating a relationship between the signal controller 200, the voltage generator 700, and the memory 800 shown in FIG. 1. FIG. 7 illustrates an equivalent circuit diagram of an output circuit 740 of the voltage generator 700. FIG. 8 exemplarily shows an equivalent circuit of a current controller 7425 of FIG. 7. FIGS. 9A, 9B, and 9C illustrate a change in the first core voltage TVDD1 according to a frame rate of the image data signal R'G'B'.

In an embodiment, the signal controller 200 may include a receiver 210, an image signal converter 220, a power controller 230, a first interface 240, and a first register 250.

In an embodiment, the voltage generator 700 may include a second interface 710, a second register 720, a compensator 730, and output circuits 740. In an embodiment, the output circuits 740 include a first output circuit 741 for outputting the gamma voltage source AVDD, a second output circuit 742 for outputting the gate-on voltage VON, a third output circuit 742 for outputting the first core voltage TVDD1, a fourth output circuit 744 for outputting the second core voltage TVDD2, and a fifth output circuit 745 for outputting the gate-off voltage VOFF. Some of the output circuits 740 may be a boost converter and some of the output circuits 740 may be a buck converter. In an embodiment, for example, the first output circuit 741 and the second output circuit 742 may be boost converters, and the third output circuit 743 and the fourth output circuit 744 may be buck converters. The fifth output circuit 745 may be a buck converter or a negative charge pump.

The gate-on voltage VON outputted from the second output circuit 742 may be generated by boosting the gamma voltage source AVDD outputted from the first output circuit 741.

In an embodiment of the inventive concept, the second core voltage TVDD2 outputted by the fourth output circuit 744 may be used as a driving voltage for driving the data driver 400.

In an embodiment of the inventive concept, the first interface 240 and the second interface 710 may be an I2C interface or a TTL interface, but are not limited thereto.

Referring to FIG. 7, the first output circuit 741 may include a DC-DC converter 7410 and a feedback circuit 7420. Although FIG. 7 shows only the first output circuit 741, at least one of the second to fifth output circuits 741 to 745 may include a DC-DC converter 7410 and a feedback circuit 7420.

The DC-DC converter 7410 may boost or reduce the input voltage VIN to generate the output voltage VOUT. For example, the DC-DC converter 7410 of the first output circuit 741 and the second output circuit 742 boosts the input voltage VIN to generate the output voltage VOUT, and the DC-DC converter 7410 of the third output circuit 743 and the fourth output circuit 744 reduces the input voltage VIN to generate the output voltage VOUT.

The feedback circuit 7420 may monitor the output voltage VOUT of the DC-DC converter 7410 and maintain it constant.

In an embodiment, the feedback circuit 7420 may include a first resistor 7421, a second resistor 7422, a first comparator 7423, a second comparator 7424, a current controller 7425, and a PWM controller 7426.

The output voltage VOUT is distributed according to a ratio of a resistance value of the first resistor 7421 and a resistance value of the second resistor 7422, and the first comparator 7423 compares the distributed output voltage VOUT with a first reference voltage Vref1 to provide an output signal to the current controller 7425.

The current controller 7425 may adjust the current of the output signal of the first comparator 7423 and provide it to the second comparator 7424. Referring to FIG. 8, one end of the current controller 7425 may be connected to a node between the first comparator 7423 and the second comparator 7424, and the other end may be connected to a battery voltage. The current controller 7425 may include a variable resistor VR and a capacitor CP. The current controller 7425 may adjust a magnitude of the current outputted from the first comparator 7423 by adjusting the resistance value of the variable resistor VR. When the resistance value of the variable resistor VR becomes small, the magnitude of the current outputted from the first comparator 7423 may be large. However, the inventive concept is not limited thereto, and the components constituting the current controller 7425 may be changed.

The second comparator 7424 may receive an output signal of the current controller 7425 and a second reference voltage Vref2 and provide an output signal to the PWM controller 7426. In an embodiment of the inventive concept, the output signal of the current controller 7425 may have a DC voltage, and the second reference voltage Vref2 and the output signal of the second comparator 7424 may be pulse wave.

The PWM controller 7426 may control the pulse of the output signal of the second comparator 7424. For example, the PWM controller 7426 may change the pulse width or the frequency of the signal from the second comparator 7424 and output a pulse signal PWM.

The DC-DC converter 7410 may receive the pulse signal PWM of the PWM controller 7426 and change or maintain the level of the output voltage VOUT.

Herein, a relationship between the signal controller 200, the memory 800, and the voltage generator 700 will be described in more detail with reference to FIG. 6.

The receiver 210 receives the image data signal RGB from an external device. The frame rate of the image data signal RGB received by the receiver 210 may vary. In an embodiment, for example, the frame rate of the image data signal RGB may vary between 30 Hz and 140 Hz, but is not limited thereto.

The image signal converter 220 may generate the converted image data signal R'G'B' by processing the image data signal RGB received by the receiver 210.

The first interface 240 loads data into the memory 800 and provides the loaded data into the first register 250. Accordingly, at least a part of the data stored in the memory 800 is loaded in the first register 250.

In an embodiment, the data loaded from the memory 800 into the first register 250 may be a look-up table including information on changes in the output voltages AVDD, VON, VOFF, TVDD1, and TVDD2 of the voltage generator 700 depending on the frame rate of the image data signal R'G'B' or changes in the electrical signals in the output circuits 740. The contents of the look-up table will be described later in more detail.

The power controller 230 may include a frequency detector 231 and an operation controller 232.

The frequency detector 231 may detect the frame rate (or frequency) of the image data signal RGB received by the receiver 210. The frequency detector 231 may provide the operation controller 232 with a signal corresponding to the detected frame rate.

The operation controller 232 generates a control signal based on the data corresponding to the frame rate of the image data signal R'G'B' detected by the frequency detector 231 among the data loaded in the first register 250. The control signal generated in the operation controller 232 may be provided to the second interface 710 of the voltage generator 700 through the first interface 240. The control signal received by the second interface 710 is stored in the second register 720, and the compensator 730 outputs the signals corresponding to the control signal stored in the second register 720 to the output circuits 740. The compensator 730 may control the feedback circuit 7420 or the DC-DC converter 7410 of the output circuits 740. That is, the voltage generator 700 may control the output voltages AVDD, VON, VOFF, TVDD1, and TVDD2 or the electrical signals in the output circuits 740 based on the control signal outputted from the operation controller 232.

In an embodiment, for example, the lookup table loaded in the first register 250 may include information corresponding to Table 1 below.

TABLE 1

| | Output voltage V of output circuits 741-745 | | | | |
|---|---|---|---|---|---|
| Frame rate (Hz) | AVDD | VON | TVDD1 | TVDD2 | VOFF |
| Greater than 0~ less than 50 | 16.80 | 30.00 | 1.20 | 1.80 | −5.60 |
| 50 or more~ less than 80 | 17.00 | 30.00 | 1.20 | 1.80 | −5.60 |
| 80 or more~ less than 110 | 17.20 | 32.00 | 1.22 | 1.82 | −5.70 |
| 110 or more~ less than 140 | 17.40 | 34.00 | 1.24 | 1.84 | −5.80 |
| 140 or more~ | 17.60 | 36.00 | 1.26 | 1.86 | −5.90 |

Table 1 shows the values of the output voltages AVDD, VON, VOFF, TVDD1, and TVDD2 of the output circuits 740 according to the frame rate of the image data signal R'G'B'. Referring to Table 1, the output voltages AVDD, VON, VOFF, TVDD1, and TVDD2 of the output circuits 740 may change when the frame rate of the image data signal R'G'B' changes. In an embodiment, as the frame rate of the image data signal R'G'B' increases, the output voltages AVDD, VON, VOFF, TVDD1, and TVDD2 of the output circuits 740 are also increased.

However, the data in Table 1 are illustrative, and the data in Table 1 may be changed according to the size or resolution of the display panel 100.

Referring to FIGS. 9A, 9B, and 9C, the effect obtained when the voltage is changed as shown in Table 1 may be known. In FIGS. 9A to 9C, it is assumed that the range of the first core voltage TVDD1 for normal operation of the signal controller 200 is 1.15 V to 1.3 V.

Referring to FIG. 9A, when the frame rate of the image data signal R'G'B' is about 60 Hz, the level of the first core voltage TVDD1 may be 1.2 V. In this case, even if a ripple voltage is generated, the level of the first core voltage TVDD1 may be 1.15 V to 1.3 V.

Referring to FIGS. 9B and 9C, when the frame rate of the image data signal R'G'B' becomes about 90 Hz or 120 Hz, the level of the ripple voltage becomes large. Therefore, when the level of the first core voltage TVDD1 is maintained at 1.2 V, the level of the first core voltage TVDD1 deviates from the normal drive range in accordance with the influence of the ripple voltage. As in the embodiment of the inventive concept shown in FIG. 9B, if the first core voltage TVDD1 is changed to 1.22 V when the frame rate is 90 Hz and if the first core voltage TVDD1 is changed to 1.24 V when the frame rate is 120 Hz, the level of the first core voltage TVDD1 may be in the normal driving range even when the ripple voltage is generated.

In addition, as the frame rate increases, the load of the display panel DP increases, and, accordingly, voltage drop in which the voltage drop AVDD, VON, VOFF, TVDD1, TVDD2 of the output circuit 740 becomes smaller may occur. Therefore, by arbitrarily increasing the voltage as shown in Table 1, it is possible to prevent or substantially prevent the display quality from being degraded by such a voltage drop.

FIGS. 9A to 9C illustrate the first core voltage TVDD1 as a reference, but the inventive concept is not limited to this. FIGS. 9A to 9C have been described with reference to the first core voltage TVDD1, but the inventive concept is not limited thereto. Such contents may be applied to the gamma voltage source AVDD, the gate-on voltage VON, the gate-off voltage VOFF, and the second core voltage TVDD2.

In an embodiment of the inventive concept, the lookup table loaded into the first register 250 may include information corresponding to Table 2 below.

TABLE 2

| | Output current (mA) of current controller 7425 | | | | |
|---|---|---|---|---|---|
| Frame rate (Hz) | AVDD | VON | TVDD1 | TVDD2 | VOFF |
| Greater than 0~ less than 50 | 0.18 | 0.08 | 0.08 | 0.04 | 0.04 |
| 50 or more~ less than 80 | 0.20 | 0.10 | 0.10 | 0.05 | 0.05 |
| 80 or more~ less than 110 | 0.24 | 0.12 | 0.12 | 0.06 | 0.06 |
| 110 or more~ less than 140 | 0.26 | 0.14 | 0.14 | 0.07 | 0.07 |
| 140 or more~ | 0.28 | 0.16 | 0.16 | 0.08 | 0.08 |

Table 2 shows an example of the value of the output current of the current controller 7425 according to the frame rate of the image data signal R'G'B'. Referring to Table 2, the output current of the current controller 7425 may change when the frame rate of the image data signal R'G'B' changes. In an embodiment, when the frame rate of the image data signal R'G'B' increases, the output current of the current controller 7425 also increases.

If the frame rate of the image data signal R'G'B' increases, the ripple voltage becomes large. If the output current of the current controller 7425 also increases, the feedback circuit 7420 may quickly respond to the voltage fluctuation.

Also, a crosstalk phenomenon occurring in the display device DD may be reduced.

However, the data in Table 2 are illustrative, and the data in Table 2 may be changed according to the size or resolution of the display panel 100.

In an embodiment of the inventive concept, the lookup table loaded into the first register 250 may include information corresponding to Table 3 below.

TABLE 3

| | Frequency (kHz) of pulse signal PWM outputted from PWM controller 7426 | | | | |
|---|---|---|---|---|---|
| Frame rate Hz | AVDD | VON | TVDD1 | TVDD2 | VOFF |
| Greater than 0~ less than 50 | 600 | 600 | 600 | 600 | 600 |
| 50 or more~ less than 80 | 600 | 600 | 600 | 600 | 600 |
| 80 or more~ less than 110 | 800 | 600 | 800 | 600 | 600 |
| 110 or more~ less than 140 | 1000 | 800 | 1000 | 800 | 800 |
| 140 or more~ | 1200 | 1000 | 1200 | 1000 | 1000 |

Table 3 shows the frequency of the pulse signal PWM outputted from the PWM controller 7426 according to the frame rate of the image data signal R'G'B'. Referring to Table 3, when the frame rate of the image data signal R'G'B' changes, the frequency of the pulse signal PWM outputted from the PWM controller 7426 may change. In an embodiment, when the frame rate of the image data signal R'G'B' increases, the frequency of the pulse signal PWM outputted from the PWM controller 7426 also increases.

As the frame rate of the image data signal R'G'B' increases, the ripple voltage increases. When the frequency of the pulse signal PWM outputted from the PWM controller 7426 increases, the magnitude of the ripple voltage may be reduced.

In addition, electromagnetic interference (EMI) generated in the display device DD may be prevented or substantially prevented.

However, the data in Table 3 are illustrative, and the data in Table 3 may be changed according to the size or resolution of the display panel 100.

In an embodiment of the inventive concept, the lookup table loaded into the first register 250 may include information corresponding to Table 4 below.

TABLE 4

| Frame rate | Skip setting of pulse signal PWM outputted from PWM controller 7426 | | | | |
|---|---|---|---|---|---|
| Hz | AVDD | VON | TVDD1 | TVDD2 | VOFF |
| Greater than 0~ less than 50 | Setting 2 | Setting 3 | Setting 3 | Setting 3 | Setting 3 |
| 50 or more~ less than 80 | Setting 2 | Setting 3 | Setting 2 | Setting 3 | Setting 3 |
| 80 or more~ less than 110 | Setting 1 | Setting 2 | Setting 1 | Setting 2 | Setting 2 |

TABLE 4-continued

| Frame rate | Skip setting of pulse signal PWM outputted from PWM controller 7426 | | | | |
|---|---|---|---|---|---|
| Hz | AVDD | VON | TVDD1 | TVDD2 | VOFF |
| 110 or more~ less than 140 | Setting 1 | Setting 2 | Setting 1 | Setting 2 | Setting 2 |
| 140 or more~ | Setting 1 | Setting 1 | Setting 1 | Setting 2 | Setting 1 |

Table 4 shows settings in which some of the pulse signal PWM outputted from the PWM controller 7426 are skipped according to the frame rate of the image data signal R'G'B'.

Figure 10A:
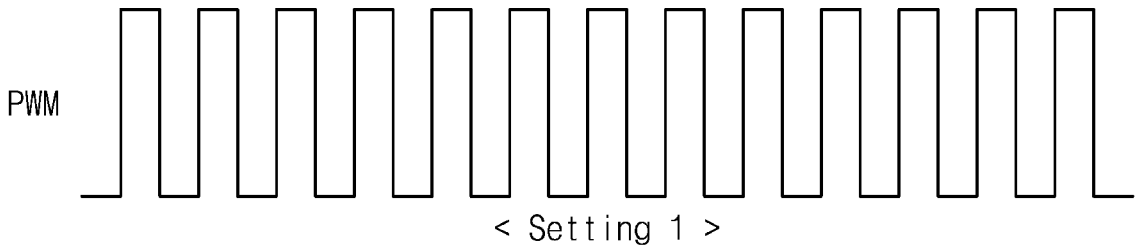
FIGS. 10A, 10B, and 10C illustrate waveforms of signals outputted from a PWM controller according to an embodiment of the inventive concept.
Figure 10B:
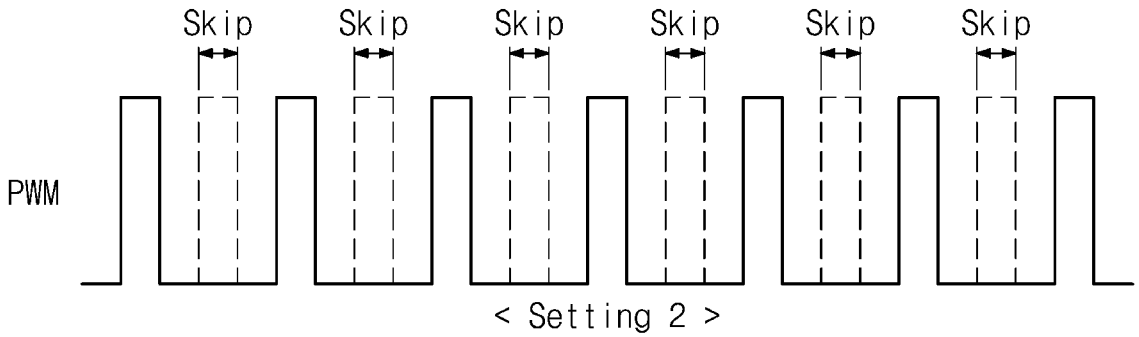
Figure 10C:
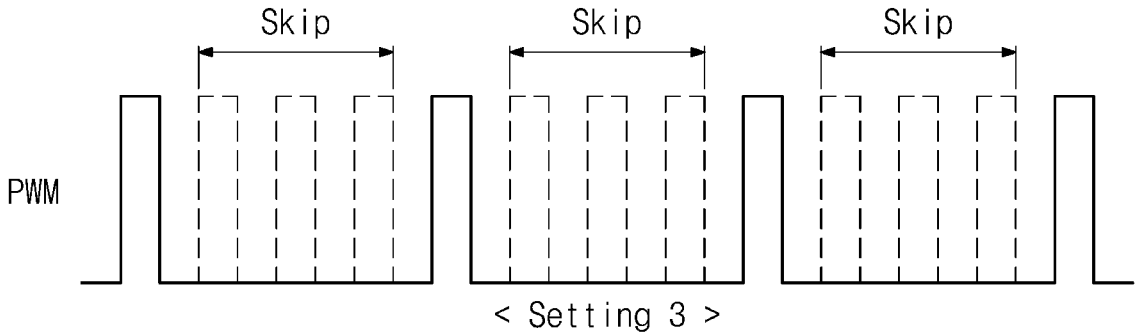

FIG. 10A shows waveform of the pulse signal PWM corresponding to setting 1. FIG. 10B shows waveform of the pulse signal PWM corresponding to setting 2. FIG. 10C shows waveform of the pulse signal PWM corresponding to setting 3.

Referring to FIG. 10A, the pulse signal PWM of setting 1 indicates that the pulses of the signal outputted from the second comparator 7424 are not skipped. Referring to FIG. 10B, the pulse signal PWM of setting 2 indicates that ½ of the pulses of the signal outputted from the second comparator 7424 are skipped. Referring to FIG. 10C, the pulse signal PWM of setting 3 indicates that ¾ of the pulses of the signal outputted from the second comparator 7424 are skipped.

Referring to Table 4 and FIGS. 10A to 10C, when the frame rate of the image data signal R'G'B' changes, the rate at which the pulses of the signal outputted from the second comparator 7424 are skipped changes. In an embodiment, as the frame rate of the image data signal R'G'B' decreases, the rate at which the pulses of the signal outputted from the second comparator 7424 are skipped is increased.

As the frame rate of the image data signal R'G'B' increases, the ripple voltage becomes larger. As the pulses of the signal outputted from the second comparator 7424 are skipped more, the ripple voltage may be reduced.

In addition, electromagnetic interference (EMI) generated in the display device DD may be prevented or substantially prevented.

However, the data of Table 4 and the waveforms of FIGS. 10A to 10C are illustrative, and the data of Table 4 and the waveforms of FIGS. 10A to 10C may be changed according to the size or resolution of the display panel 100.

According to an embodiment of the inventive concept, even when the frame rate of the image data signal applied from the outside changes, IR-drop, voltage ripple, crosstalk, or EMI may be prevented or substantially prevented from occurring inside the display device. Accordingly, a display device that displays high-quality images may be provided.

Although some exemplary embodiments of the inventive concept have been described, it is understood that the inventive concept should not be limited to these exemplary embodiments, but various changes and modifications can be made by one of ordinary skill in the art within the spirit and scope of the inventive concept as herein claimed.

What is claimed is:

1. A display device comprising:

a memory configured to store a plurality of data;

a signal controller comprising a receiver to receive image data, a first register to read the plurality of data stored in the memory, and a power controller, wherein the power controller comprises a frequency detector to detect a frequency of the received image data and an operation controller to output a control signal based on data corresponding to the detected frequency among the plurality of data read by the first register; and a voltage generator comprising a plurality of output circuits to output a plurality of voltages in correspondence to the control signal, wherein at least one of the plurality of output circuits comprises:

a DC-DC converter configured to output an output voltage; and a feedback circuit configured to control an output of the DC-DC converter and comprising a first comparator to compare the output voltage with a first reference voltage, a second comparator to compare an output of the first comparator with a second reference voltage, and a PWM controller to output a pulse signal based on an output of the second comparator and the control signal, wherein the output voltage of the DC-DC converter is changed in correspondence to the control signal, and wherein as the detected frequency is higher, a frequency of the pulse signal outputted from the PWM controller becomes higher.

2. The display device of claim 1, wherein as the detected frequency is higher, the output voltage of the DC-DC converter becomes greater.

3. The display device of claim 2, wherein as the detected frequency is higher, a current between the first comparator and the second comparator becomes greater.

4. The display device of claim 1, wherein the feedback circuit further comprises a current controller having one end connected to a node between the first comparator and the second comparator and another end connected to a ground voltage, and the current controller comprises a variable resistor and a capacitor.

5. The display device of claim 4, wherein a resistance value of the variable resistor is changed in correspondence to the detected frequency.

6. The display device of claim 5, wherein when the resistance value of the variable resistor is smaller, a magnitude of the current outputted from the current controller becomes greater.

7. The display device of claim 1, wherein the signals outputted by the PWM controller comprises a plurality of pulse waves, and a part of the plurality of pulse waves is skipped in correspondence to the detected frequency.

8. The display device of claim 7, wherein as the detected frequency is smaller, a number of pulse waves skipped among the plurality of pulse waves increases.

9. The display device of claim 8, wherein when the detected frequency changes, a pulse width of each of the plurality of pulse waves is constant.

10. The display device of claim 1, further comprising a display panel, a gate driver, a data driver, and a gamma voltage generator, wherein the plurality of output circuits comprises:

a first output circuit configured to boost an inputted reference voltage to provide a gamma voltage source to the gamma voltage generator;

a second output circuit configured to boost the gamma voltage source to provide a gate-on voltage to the gate driver;

a third output circuit configured to reduce an inputted reference voltage to provide a core voltage to the signal controller;

a fourth output circuit configured to reduce an inputted reference voltage to provide a driving voltage to the data driver; and a fifth output circuit configured to reduce an inputted reference voltage to provide a gate-off voltage to the gate driver.

11. The display device of claim 10, wherein the first output circuit and the second output circuit are respectively a boost converter, the third output circuit and the fourth output circuit are respectively a buck converter, and the fifth output circuit is a negative charge pump.

12. The display device of claim 11, wherein a voltage of the gamma voltage source is 16 V or more and 18 V or less, the gate-on voltage is 28 V or more and 38 V or less, the core voltage is 1 V or more and 2 V or less, the driving voltage is 1 V or more and 2 V or less, and the gate-off voltage is −7 V or more and −5 V or less.

13. A display device comprising:

a memory configured to store a plurality of data;

a signal controller configured to detect a frame rate of an externally applied image data signal, select data corresponding to the detected frame rate among the plurality of data, and output a control signal corresponding to the selected data; and a voltage generator comprising a DC-DC converter to determine an output voltage in correspondence to the control signal, and a feedback circuit to determine a current flowing in the voltage generator and a frequency of an outputted signal in correspondence to the control signal, wherein the feedback circuit comprises a first comparator, a second comparator to receive an output of the first comparator, and a current controller to control a current value of the output of the first comparator, and wherein the current controller comprises a variable resistor and a capacitor, and a resistance value of the variable resistor is determined in correspondence to the detected frame rate.

14. The display device of claim 13, wherein signals outputted by the feedback circuit comprise a plurality of pulse waves, and a part of the plurality of pulse waves is skipped in correspondence to the detected frame rate.

15. A display device comprising:

a memory configured to store a plurality of data;

a signal controller configured to detect a frame rate of an externally applied image data signal, select data corresponding to the detected frame rate among the plurality of data, and output a control signal corresponding to the selected data; and a voltage generator comprising a DC-DC converter to determine an output voltage in correspondence to the control signal, and a feedback circuit to determine a current flowing in the voltage generator and a frequency of an outputted signal in correspondence to the control signal, wherein signals outputted by the feedback circuit comprise a plurality of pulse waves, and a part of the plurality of pulse waves is skipped in correspondence to the detected frame rate, and wherein as the detected frame rate is smaller, a number of pulse waves skipped among the plurality of pulse waves increases.

16. The display device of claim 13, further comprising a display panel, a gate driver, a data driver, and a gamma voltage generator, wherein the voltage generator comprises a plurality of output circuits comprising:

a first output circuit configured to provide a gamma voltage source to the gamma voltage generator;

a second output circuit configured to provide a gate-on voltage to the gate driver;

a third output circuit configured to provide a core voltage to the signal controller;

a fourth output circuit configured to provide a driving voltage to the data driver; and a fifth output circuit configured to provide a gate-off voltage to the gate driver.

17. The display device of claim 16, wherein the first output circuit and the second output circuit are respectively a boost converter, the third output circuit and the fourth output circuit are respectively a buck converter, and the fifth output circuit is a negative charge pump.

* * * * *